US008203089B2

(12) United States Patent
Skrt

(10) Patent No.: US 8,203,089 B2
(45) Date of Patent: Jun. 19, 2012

(54) CASING FOR AN ELECTRIC HOUSEHOLD APPLIANCE SWITCH

(75) Inventor: Alojz Skrt, Kobarid (SI)

(73) Assignee: ITW Metaflex, D.O.O. Tolmin, Tolmin (SI)

( * ) Notice: Subject to any disclaimer, the term of this patent is extended or adjusted under 35 U.S.C. 154(b) by 233 days.

(21) Appl. No.: 12/676,205

(22) PCT Filed: Sep. 2, 2008

(86) PCT No.: PCT/SI2008/000046

§ 371 (c)(1),
(2), (4) Date: Mar. 3, 2010

(87) PCT Pub. No.: WO2009/031982

PCT Pub. Date: Mar. 12, 2009

(65) Prior Publication Data

US 2010/0252404 A1 Oct. 7, 2010

(30) Foreign Application Priority Data

Sep. 4, 2007 (SI) ..... P200700212

(51) Int. Cl.
*H01H 13/04* (2006.01)

(52) U.S. Cl. ..... 200/293

(58) Field of Classification Search ..... 200/292, 200/293, 310, 311, 314, 512–520
See application file for complete search history.

(56) References Cited

U.S. PATENT DOCUMENTS 1,869,646 A 8/1932 Anderson
2,691,084 A * 10/1954 Miller ..... 200/293
3,909,768 A * 9/1975 Woods ..... 200/283
4,377,809 A * 3/1983 Lawford ..... 340/623
5,153,395 A 10/1992 Schantz et al.
5,416,970 A * 5/1995 Kadlubowski ..... 200/293

FOREIGN PATENT DOCUMENTS

DE 8801986 U1 5/1988
DE 9200916 U1 4/1992

OTHER PUBLICATIONS

ISR for PCT/SI2008/000046, mailed Dec. 23, 2008.

* cited by examiner

*Primary Examiner* — Briggitte R Hammond

(74) *Attorney, Agent, or Firm* — Lowe Hauptman Ham & Berner LLP

(57) ABSTRACT

An upper part of an electric switch casing is positioned over a lower part of the casing and is form-locked therewith. Between said parts a first chamber, in which voltage carrying connecting pieces are mounted, is formed between peripheral vertical side walls of the lower part and a vertical partition of the lower part. The width and the height of a first gap between the peripheral vertical side wall of the upper part of the casing and the peripheral vertical side wall of the lower part of the casing as well as of a second gap between the vertical partition projection of the upper part of the casing and the vertical partition of the lower part of the casing are such that the capillary elevation of liquids used in household occurring in said gaps is lower than the height of said gaps the width of said first and second gaps being kept as low as possible. The casing of the invention for the electric household appliance switch characterizes itself in that it can be assembled in a simple way, it occupies little space and a household appliance user is reliably protected against coming in contact with high voltage carrying connecting pieces.

3 Claims, 1 Drawing Sheet

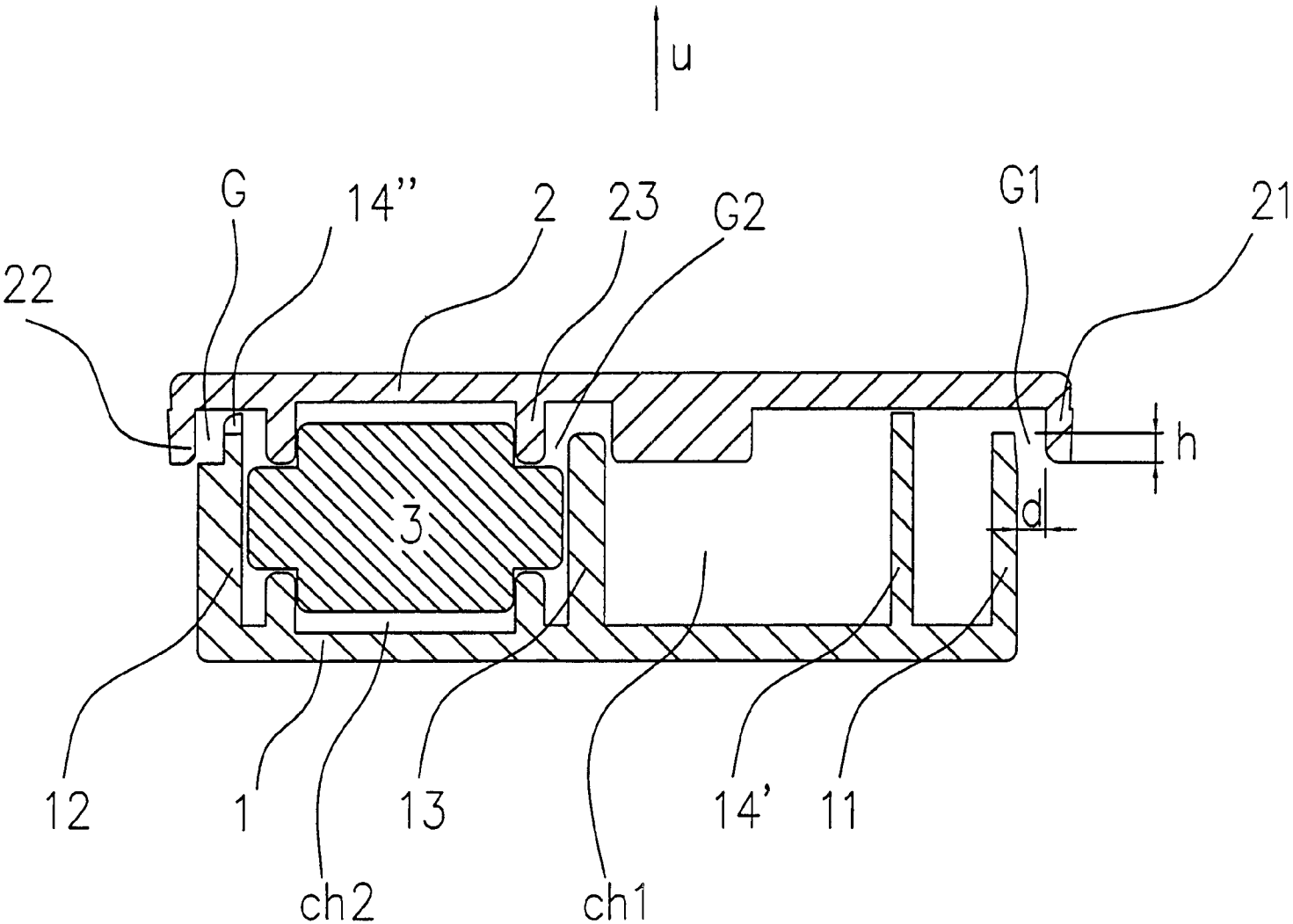
u
21
G1
G2
23
2
14''
G
22
h
d
11
14'
ch1
13
3
ch2
1
12

CASING FOR AN ELECTRIC HOUSEHOLD APPLIANCE SWITCH

RELATED APPLICATIONS

The present application is national phase of International Application Number PCT/SI2008/000046 filed Sep. 4, 2008, and claims priority to Slovenia Application number P 2007 0 0212 filed Sep. 4, 2007, the disclosures of which are hereby incorporated by reference herein in their entirety.

The invention concerns a casing for an electric household appliance switch, which casing is composed of a lower part of the casing and an upper part of the casing, wherebetween a first chamber, in which voltage carrying connecting pieces are mounted, and a second chamber, in which a switch actuating rod moves, are formed, both parts of the casing being assembled with each other in a simple manner, yet impermeably to liquids used in a household.

An electric switch used to be installed in a household appliance in a way that it was covered from the outside by an additional barrier or cover mounted in front of the electric switch. This prevented a liquid used in a household either a detergent for cleaning or spilled on the appliance from entering the interior of the switch. This type of protection of an electric switch against liquids is expensive due to the fact that an additional barrier or cover has to be built into a household appliance and it is space consuming.

Protection of an electric switch against penetration of a liquid into its interior can be carried out in a more price efficient way. The casing for an electric switch must be designed in a way that voltage carrying connecting pieces of an electric household appliance switch do not come into contact with any liquid used in a household. There are two options of achieving it.

In the first case, the casing for an electric household appliance switch is composed of a lower part of the casing and an upper part of the casing, wherebetween a first chamber, in which voltage carrying connecting pieces are mounted, and a second chamber, in which a switch actuating rod moves, are formed (Arcoelectric Ltd., www.arcoelectric.co.uk, the switch E3102AA). The first chamber is hermetically sealed, what is accomplished by ultrasonic welding of both casing parts. This process calls for an expensive, sophisticated and energy wasting appliance for ultrasonic welding.

In the second case, a labyrinth is made around the chamber, in which voltage carrying connecting pieces are mounted, thus increasing the external dimensions of the electric switch.

As far as the drawbacks of the currently known electric household appliance switches are concerned the technical problem of the present invention is how to construct an electric switch or its casing, which is composed of a lower part of the casing and an upper part of the casing in a way that said casing parts will be assembled in a simple way and will prevent penetration of liquids into its chamber, in which voltage carrying connecting pieces are mounted.

Said technical problem is solved by a casing of the invention for an electric household appliance switch as characterized by the features of the characterizing portion of the first claim, and the variants of the embodiment are characterized by dependent claims.

The casing of the invention for an electric household appliance switch is characterized in that it may be assembled in a simple way, it occupies little space and a household appliance user is reliably protected against getting in contact with high-voltage carrying connecting pieces.

The invention will now be explained in more detail by way of the description of an embodiment and the accompanying drawing representing in the sole FIGURE a vertical section across a casing for an electric household appliance switch.

A casing of the invention for an electric household appliance switch is derived from a known casing, which is composed of a lower part 1 of the casing and an upper part 2 of the casing (FIGURE). An arrow u points upwards. Between the parts 1 and 2 of the casing there is a first chamber Ch1 housing voltage carrying connecting pieces, and a second chamber Ch2, in which a switch actuating rod 3 moves.

Said known casing is improved by the invention in the following way.

The upper part 2 of the casing is positioned over the lower part 1 of the casing. Both parts 1 and 2 of the casing are form-locked to each other by means of bolts (not represented) provided in one part of the casing and holes (not represented) corresponding to the bolts and provided in the other part of the casing.

Peripheral vertical side walls 21, 22 of the upper part 2 of the casing project over and externally surround peripheral vertical side walls 11, 12 of the lower part 1 of the casing.

A vertical partition 13 salient out from an upper surface of the lower part 1 of the casing separates the first chamber Ch1 from the second chamber Ch2. A vertical partition projection 23 made salient out from a lower surface of the upper part 2 of the casing, externally with respect to the first chamber Ch1, surrounds the upper part of the vertical partition 13.

Finally, in the preferred embodiment, the width d and the height h of a first gap G1 between the peripheral vertical side wall 21 of the upper part 2 of the casing and the peripheral vertical side wall 11 of the lower part 1 of the casing as well as of a second gap G2 between the vertical partition projection 23 of the upper part 2 of the casing and the vertical partition 13 of the lower part 1 of the casing are interconnected in a way that the capillary elevation of any liquid used in the household occurring in said gaps G1, G2 is lower than the height h of said gaps G1, G2, however, the width of said first and second gaps G1, G2 should be kept as low as possible.

The liquid reaching the casing of the electric switch despite protection cannot reach the upper borders of the vertical side wall 11 of the lower part 1 and of the vertical partition 13 through said gaps G1, G2 and spill over the interior surfaces of the first chamber Ch1 or moisten them. The liquid can thus not reach the voltage carrying connecting pieces.

With the casing of the invention assembled, the upper part 2 of the casing and the lower part 1 of the casing are somewhat spaced. The distance of upper edges of peripheral vertical side walls 11, 12 of the lower part 1 of the casing and that of the vertical partition 13 from the lower surface of the upper part 2 of the casing is defined by spacing projections 14', 14" originating in the lower part 1 of the casing and touching the lower surface of the upper part 2 of the casing.

Third gaps G between the peripheral vertical side walls 22 of the upper part 2 of the casing and the peripheral vertical side walls 12 surrounding the second chamber Ch2 of the lower part 1 of the casing may also be implemented in the same way as said gaps G1 and G2.

The electric household appliance switch provided with the casing of the invention complies with the standard IEC 60335-2-24. The user is protected against coming in contact with high voltage carrying pieces.

The invention claimed is:

1. A casing for an electric household appliance switch, comprising:

a lower part, an upper part a first chamber between said lower part and said upper part and a second chamber between said lower part and said upper part, a switch actuating rod movable within said second chamber wherein the upper part of the casing is positioned over the lower part of the casing and is form-locked therewith, wherein peripheral vertical side walls of the upper part of the casing externally surround peripheral vertical side walls of the lower part of the casing, a vertical partition projects out from an upper surface of the lower part of the casing and separates the first chamber from the second chamber, a vertical partition projection extends out from a lower surface of the upper part of the casing, externally with respect to the first chamber, and surrounds the upper part of the vertical partition, wherein the width and the height of a first gap between the peripheral vertical side wall of the upper part of the casing and the peripheral vertical side wall of the lower part of the casing as well as of a second gap between the vertical partition projection of the upper part of the casing and the vertical partition of the lower part of the casing are configured such that the capillary elevation of liquids in said first gap and said second gap is lower than the height of said first and said second gaps, and wherein the width of said first and said second gaps being kept as low as possible.

2. The casing of claim 1, wherein the upper part of the casing and the lower part of the casing are fastened to each other by a plurality of bolts and through corresponding holes, wherein the spacing projections originating in the lower part of the casing define the separation of the upper edges of the peripheral vertical side walls of the lower part of the casing and that of the vertical partition from the lower surface of the upper part of the casing.

3. The casing of claim 1, further comprising a third gap between the peripheral vertical side walls of the upper part of the casing and the peripheral vertical side walls surrounding the second chamber of the lower part of the casing are implemented in the same way as the first gap and the second gap.

* * * * *